US005365715A

United States Patent [19]

Steinmetz et al.

[11] Patent Number: 5,365,715

[45] Date of Patent: Nov. 22, 1994

[54] ROD TYING APPARATUS

[76] Inventors: James W. Steinmetz, 0045 Rabbit Rd., Carbondale, Colo. 80623; Roy C. Meller, III, 0140 Elk La., Redstone, Colo. 81623

[21] Appl. No.: 149,080

[22] Filed: Nov. 9, 1993

[51] Int. Cl.[5] ..... E04C 3/30

[52] U.S. Cl. ..... 52/726.1; 52/295

[58] Field of Search ..... 52/698, 431, 432, 438, 52/442, 712, 584, 649.3, 649.4, 649.5, 649.7, 726.1, 726.3, 295, 566; 403/291

[56] References Cited

U.S. PATENT DOCUMENTS

| | | | |
|---|---|---|---|
| 1,416,709 | 5/1922 | Hahn . | |
| 1,657,441 | 1/1928 | Huovinen . | |
| 1,891,597 | 12/1932 | Jagdmann . | |
| 1,986,172 | 1/1935 | Wilson . | |
| 2,250,763 | 7/1941 | Hild | 72/44 |
| 3,040,402 | 1/1962 | Rible | 24/123 |
| 3,067,401 | 12/1962 | Rhodes . | |
| 3,390,905 | 7/1968 | Stewart | 52/726.1 X |
| 3,440,334 | 4/1969 | Blomstrand | 174/87 |
| 3,552,787 | 1/1971 | Yee | 287/108 |
| 3,627,264 | 12/1971 | Pruitt | 249/20 |
| 3,779,593 | 12/1973 | Neuroth | 403/291 X |
| 3,828,502 | 8/1974 | Carlsson | 52/309 |
| 3,907,447 | 9/1975 | Arkharov | 403/316 |
| 4,055,875 | 11/1977 | Strickland | 24/115 R |
| 4,095,389 | 6/1978 | Outram et al. | 52/726.1 X |
| 4,143,986 | 3/1979 | Antosh | 52/726.1 X |
| 4,619,096 | 10/1986 | Lancelot, III | 52/726. |
| 4,627,212 | 12/1986 | Yee | 52/726.1 |
| 4,936,062 | 6/1990 | Golston et al. | 52/127.1 |
| 5,152,118 | 10/1992 | Lancelot | 52/726.1 |

*Primary Examiner*—Carl D. Friedman
*Assistant Examiner*—Creighton Smith
*Attorney, Agent, or Firm*—Duane Burton

[57] ABSTRACT

An apparatus for tying elongated members together includes an attachment element and a mating centering element. In use, the attachment element is attached to one of the members to be tied and the centering element is used to align and juxtapose the attached member to a stationary member. Two coils of wire are wrapped around the attachment element and centering element. Upon separation of the rod attachment and rod centering elements, the coils of wire are adapted to tighten around the aligned members and tie the members together. The apparatus of the invention is particularly suited to blind tying reinforcing rods in a structure formed of concrete masonry units.

24 Claims, 4 Drawing Sheets

ROD TYING APPARATUS

BACKGROUND OF THE INVENTION

1. Field of the Invention

This invention relates to the construction industry and in particular to an improved method and apparatus for trying metal rods such as rebar together. The method and apparatus of the invention are particularly suited to blind tying reinforcing rods in a concrete masonry unit wall structure.

2. Description of the Prior Art

In the construction industry, it is often necessary no tie together two or more rods such as rebar used for reinforcing a structure. As an example, in the construction of walls for homes and businesses, concrete masonry units (CMUs) or fired clay masonry units (FCMUs) are stacked and reinforced with rebar. In a typical wall construction, a foundation or stem wall is first poured in place. The foundation includes evenly spaced steel reinforcing rods that are anchored in the foundation. The reinforcing rods are typically formed of a length of rebar embedded in the foundation. The reinforcing rods extend vertically upward from the foundation by distance of about two to three feet.

During the construction process, rows of concrete masonry units are stacked on the foundation with mortar placed between the units. The concrete masonry units are usually rectangular in shape and have two openings or cells formed through the unit. After the wall has been erected, the cells of the concrete masonry units can be filled with concrete grout to rigidify the structure.

With such a wall constructed of concrete masonry units, the first couple of rows of masonry units are placed over the steel reinforcing rods anchored in the foundation. In order to provide maximum strength for the wall, however, it is desirable to extend the reinforcing rods so that each row masonry units is reinforced. Typically, this is accomplished by tying or splicing additional lengths of reinforcing rods, such as metal rebar, to the reinforcing rods anchored in the foundation.

A problem associated with this method of construction is in tying the additional lengths of rebar to the reinforcing rods anchored in the foundation. Since the reinforcement rods are contained within the concrete masonry units, this is a "blind tie". One method of tying the rods together, is to build the wall to its final height and then insert the additional lengths of rebar through the completed wall. Access holes are then knocked through the concrete masonry units at the places where the pairs of rods come together. This enables the rods to be tied together using wire. Sometimes the access holes are cut in the concrete masonry units before their placement in the wall. The access holes must necessarily be repaired following completion of the wall. As is apparent, this is an expensive and time consuming process. In addition, the holes may detract from the overall appearance of the finished wall, especially with decorative or tinted masonry units.

A second method for tying the reinforcing rods is to the rods together before the wall is constructed, and then to erect the wall over the tied reinforcing rods. From the standpoint of safety, however, this is a very undesirable procedure. This is because the full height of the tied reinforcement rods may be eight feet or more. The masons constructing the wall, must therefore lift each concrete masonry unit this entire height in order to place the masonry units over the tied reinforcement bars. Since these concrete masonry units typically weigh on the order of 40 pounds or more, back injuries are common. Even more dangerous is that a mason will sometimes stand on a stool, or another masonry unit stood on its end, to gain an additional height advantage for lifting the masonry unit. This increases the possibility of a man falling and injuring himself. This problem is compounded because the masons often work on scaffolds which are many feet above the ground.

In view of the foregoing, there is a need in the art for improved procedures for tying reinforcing rods and other elongated members. Accordingly, it is an object of the present invention to provide an improved method and apparatus for tying or splicing elongated members, such as metal reinforcement rods made of rebar. It is a further object of the present invention to provide an improved method and apparatus for blind tying reinforcement rods in a concrete masonry unit wall structure. It is yet another object of the present invention to provide an improved method and apparatus for tying reinforcement rods and other elongated members that is fast, efficient and inexpensive and which permits concrete masonry unit walls to be safely constructed.

SUMMARY OF THE INVENTION

In accordance with the present invention, an improved method and apparatus for tying members together are provided. The method and apparatus of the invention are particularly suited to blind tying, or splicing, added lengths of reinforcing rod for a concrete masonry unit wall to reinforcing rods anchored in a foundation for the wall.

The rod tying apparatus includes coils of wire contained on two mating separable elements. The separable elements are designated herein as a rod attachment element and a rod centering element. Both of these elements have mating circular peripheral configurations. The coils of wire are wound or spooled in opposite helical directions on the rod attachment element and the rod centering element. Separation of the rod attachment element and rod centering element uncoils the wire around the rods and ties the two rods together.

In use, the rod attachment element is attached to one end of a length of reinforcing rod to be tied to an anchored reinforcing rod. The rod attachment element includes a rod holder and a threaded setscrew for attaching the added reinforcing rod. The rod centering element is adapted to be placed over one end of the anchored reinforcing rod and functions to align the added length of reinforcing rod with the anchored reinforcing rod. An operator, by pushing on the added reinforcing rod, effects a separation of the attachment element and the centering element of the rod tying apparatus. As the separation proceeds, the coils of wire contained on the elements tighten around the aligned rods and tie the rods together.

The rod tying apparatus is adapted to tie two rods together at several points over a length of several inches. The number and spacing of the tie points are achieved by forming the coils of wire with a predetermined length and number of coils. The weight of the added reinforcing rod maintains tension on the wires and causes the wires to tightly grip and tie the two rods together. Increased pressure, initiated by an operator pushing on the added reinforcing rod, can be used to tighten the wires even tighter. Alternately, an operator can lift the added length of reinforcing rod and separate the rods. For a concrete masonry unit wall the rod tying apparatus is adapted to remain encased within the wall when the wall cell structure is filled with concrete grout.

In general, the rod tying apparatus can be used whenever it is necessary to tie two or more elongated members to one another. Another exemplary use would be in the repair of submerged pylons.

Other objects, advantages, and capabilities of the invention will become more apparent as the following more particular description of the preferred embodiments of the invention as illustrated in the accompanying drawing.

DETAILED DESCRIPTION OF THE PREFERRED EMBODIMENT

Figure 1:
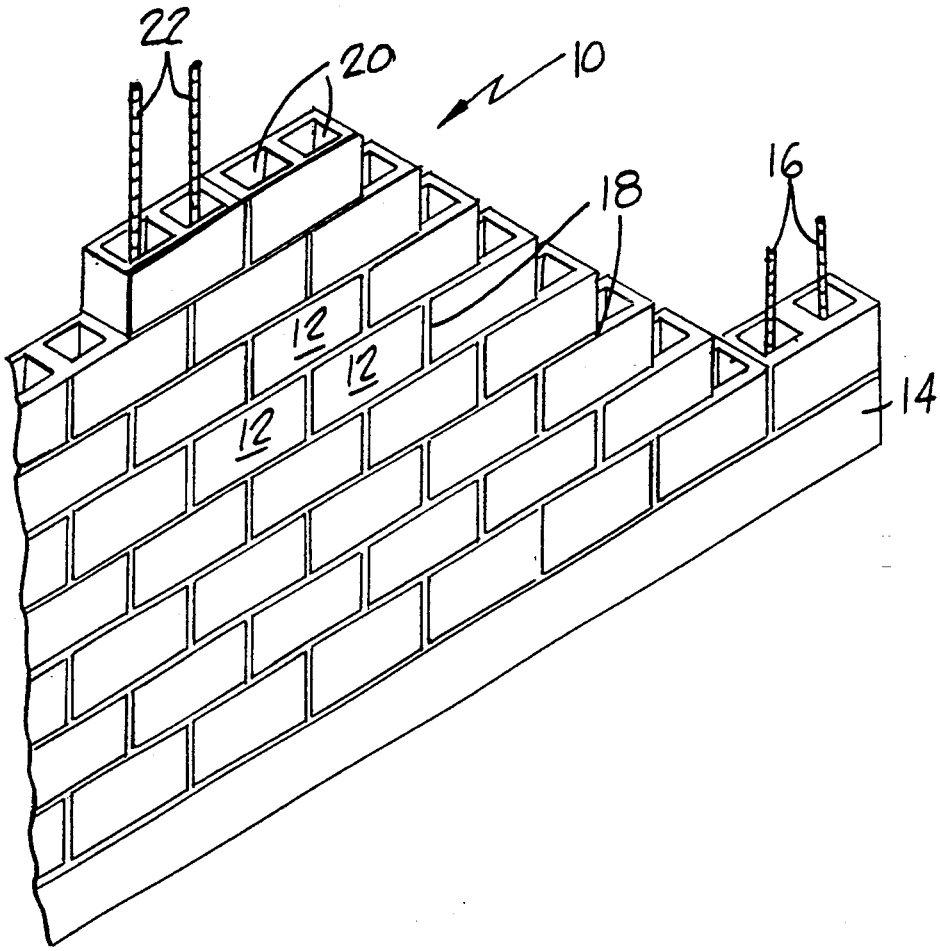
FIG.1 (PRIOR ART)
FIG. 1 is a perspective view of a typical prior art concrete masonry unit wall shown under construction.
Figure 3:
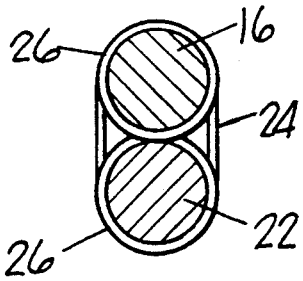
FIG 3 (PRIOR ART)
FIG. 3 is a cross section taken through section line 3—3 of FIG. 2.
Figure 2:
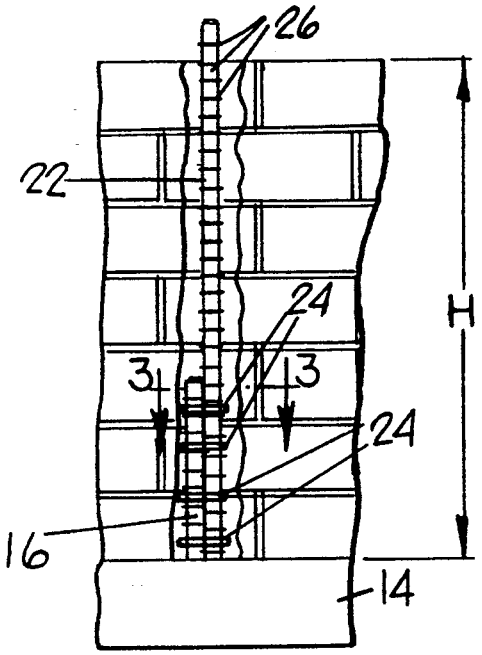
FIG.2 (PRIOR ART)
FIG. 2 is a schematic view of the wall shown in FIG. 1, partially cut away, and illustrating the tying of an added length of reinforcing rod to a reinforcing rod anchored in a foundation for the wall.

Referring now to FIGS. 1–3, the construction of a reinforced concrete masonry unit wall 10 is shown. The concrete masonry unit wall 10 includes concrete masonry units 12 stacked in rows on a poured in place foundation 14. Anchored within the foundation 14 and extending vertically out of the foundation 14, at evenly spaced intervals, are anchored reinforcing rods 16. Such anchored reinforcing rods 16 are typically formed of metal rebar or the like and extend two to three feet above the foundation 14.

The wall 10 is constructed by laying courses, or staggered rows of the concrete masonry units 12, substantially as shown. Mortar 18 is applied between the abutting edges of the concrete masonry unit 12. Each concrete masonry units 12 is formed of concrete or fired clay cast in a rectangular shape. In addition, each concrete masonry unit 12 includes a pair of vertically extending cells 20. Following erection of the wall 10 concrete grout poured into the aligned cells 20 to rigidify the structure, During construction of the foundation 14, the anchored reinforcing rods 16 are spaced at intervals that match the spacing of the cells 20 in the concrete masonry units 12. The first two or more rows of concrete masonry units 12 are placed over the anchored reinforcing rods 16. The anchored reinforcing rods 16 reinforce the structure and further rigidify the wall 10.

Since the height "H" (FIG. 2) of the wall may be 8–10 feet or more, and because the reinforcing rods 16 are only two to three feet in length, however, added lengths of reinforcing rod 22 must be used for reinforcing the upper portions of the wall 10. This added reinforcing rod 22 must be tied or spliced to the anchored reinforcing rods 16 anchored in the foundation 14 for transferring tension loads throughout the structure.

The anchored reinforcing rods 16, and also the added reinforcing rods 22 may be formed of steel rebar. Construction rebar is typically formed with an oval cross sectional configuration and includes raised ribs 26. When two pieces of rebar are tied together, the raised ribs 26 interlock and transmit loads between the tied or spliced rods. This is clearly shown in FIG. 3. Wire ties 24 are used to tie the adjacent reinforcing rods 16 and 22 to one another. As shown in FIG. 2, several wire ties 24 are evenly spaced over a length of several inches. Various construction codes specify the number of wire ties 24 that are required per foot for various structures. The wire tying process is typically done by hand and is a labor intensive and time consuming process.

Moreover, unless the reinforcing rods 16 and 22 are tied together before erection of the wall, the ties 24 must be made internally or within the wall. Such ties are referred to in the art as "blind ties". In the past, in order to make these ties 24, access holes have typically been knocked in the concrete masonry units 12. As previously explained, this is an expensive and time consuming procedure and may detract from the appearance of the wall 10. Alternately, the reinforcing rods 16 and 22 can be tied prior to erection of the wall 10. In that case, however, the masons must lift each and every concrete masonry unit 12 the entire height "H" and over the added lengths of reinforcing rod 22. Again as previously explained, this is an unsafe situation.

The present invention is directed to a method and apparatus for making such a blind tie efficiently and inexpensively. Using the method and apparatus of the invention, a concrete masonry unit wall 10 can be safely and efficiently erected.

Figure 4:
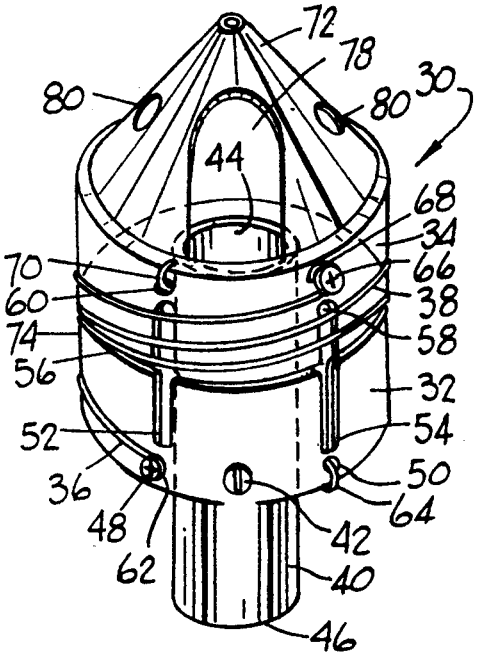
FIG. 4 is a perspective view of a rod tying apparatus constructed in accordance with the invention.

Referring now to FIG. 4, a rod tying apparatus 30 constructed in accordance with the invention is shown. The rod tying apparatus 30 includes a rod attachment element 32 and a rod centering element 34. The rod tying apparatus 30 and rod attachment element 32 have mating peripheral configurations and are alignable and separable from one another. The rod tying apparatus 30 also includes a first coil of wire 36 and a second coil of wire 38 attached to and wrapped around both the rod attachment element 32 and the rod centering element 34. The coils of wire 36, 38 are nested one within the other. In addition, the coils of wire 36, 38 are preferably oriented in opposite helical directions (or 180° out of phase) such that as the rod attachment element 32 and rod centering element 34 are moved in opposite directions (FIGS. 5A–5C), the coils of wire 36, 38 will move towards one another and tighten around the reinforcing rods 16, 22 placed therebetween.

The rod attachment element 32 functions to attach the added reinforcing rod 22 to the rod tying apparatus 30. The rod attachment element 32, viewed separately, is a generally ring-like member with a cylindrical outer peripheral configuration. The rod attachment element 32 may be formed of a material suitable for construction projects, such as metal or hard plastic. In addition, the rod attachment element 32 must be sized to fit conveniently within a cell 20 (FIG. 1) of a concrete masonry unit 12.

A rod holder 40 is attached to the rod attachment element 32 by welding or other suitable means. The rod holder 40 is an elongated tubular member and may be formed from a length of metal tubing or the like. The rod holder 40 is adapted to receive and retain a length of rod such as the added length of reinforcing rod 22. The rod holder 40 may be sized to receive different sizes of rod (e.g., quarter inch to one inch rebar). Moreover, an alternate embodiment rod tying apparatus may be constructed to accommodate large diameter members (i.e., several inches or more) such as construction pylons.

Figure 6:
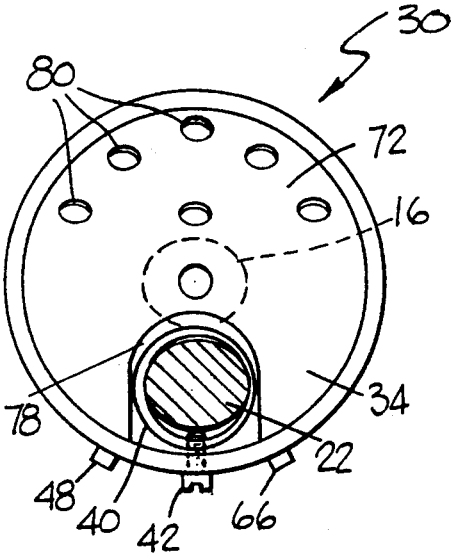
FIG. 6 is a cross section taken along section line 6—6 of FIG. 5A.

A threaded retaining fastener, in the form of a slotted setscrew 42, is threaded through the rod attachment element 32 and into the inside diameter of the rod holder 40. The setscrew 42 can be used for securing the added reinforcing rod 22 to the rod holder 40. The function of the setscrew 42 and rod holder 40 are clearly shown in FIG. 6. An upper end 44 of the rod holder 40 is open for receiving the added reinforcing rod 22. A lower end 46 of the rod holder 40 may be closed off with a plate or the like for positioning or stopping the attachment element 32 on an end of the added reinforcing rod 22.

The rod attachment element 32 also includes a wire fastener 48 in the form of a phillips head sheet metal screw or the like on which an end portion 62 of the first coil of wire 36 is fastened. In addition, a through hole 50 is provided for attaching an end portion 64 of the second coil of wire 38. The end portion 64 of the second coil of wire 38 is placed through the through hole 50 and bent. Similarly, the rod centering element 34 includes a wire fastener 66 in the form of a phillips head sheet metal screw or the like for attaching an end portion 68 of the second coil of wire 38. The rod centering element 34 also includes a through hole 60 for attaching an end portion 70 of the first coil of wire 36 which is placed through the hole 60 and bent. Alternately, other methods of attaching the coils of wire 36, 38 to the elements 32, 34, such as spot welding may be employed.

In addition, rectangular shaped cutouts 52, 54 are formed in the rod attachment element 32 along the mating peripheral edge with the rod centering element 34. The cutouts 52, 54 mate with similar cutouts 56, 58 on the rod centering element 34 to form rectangular openings. These openings are required so that the coils of wire 36, 38 can be nested and appropriately spooled in opposite helical directions onto the rod attachment element 32 and rod centering element 34.

As shown in FIG. 4, the end portion 64 of the second coil of wire 38, attached to through hole 50, is placed through the cutout 54 and under the coils of the first coil of wire 36 wrapped around the rod attachment element 32. A similar situation exists for the end portion 70 of the first coil of wire 36 which is attached to the through opening 60 in the rod centering element 34. The end portion 70 is placed through the cutout 56 and under the coils of the second coil of wire 38 wrapped around the rod centering element 34.

Still referring to FIG. 4, the rod centering element 34 of the rod tying apparatus 30 is also a generally ring like member but with a conical projection 72. As will hereinafter be more fully explained, the conical projection 72 functions as a guide means to center the rod tying apparatus 30 on the anchored reinforcing rod 16 (FIG. 8A–8B) anchored in the foundation 14. Like the rod attachment element 32, the rod centering element 34 may be formed of a material suitable for construction such as metal or hard plastic.

Figures 5A, 5B, 5C:
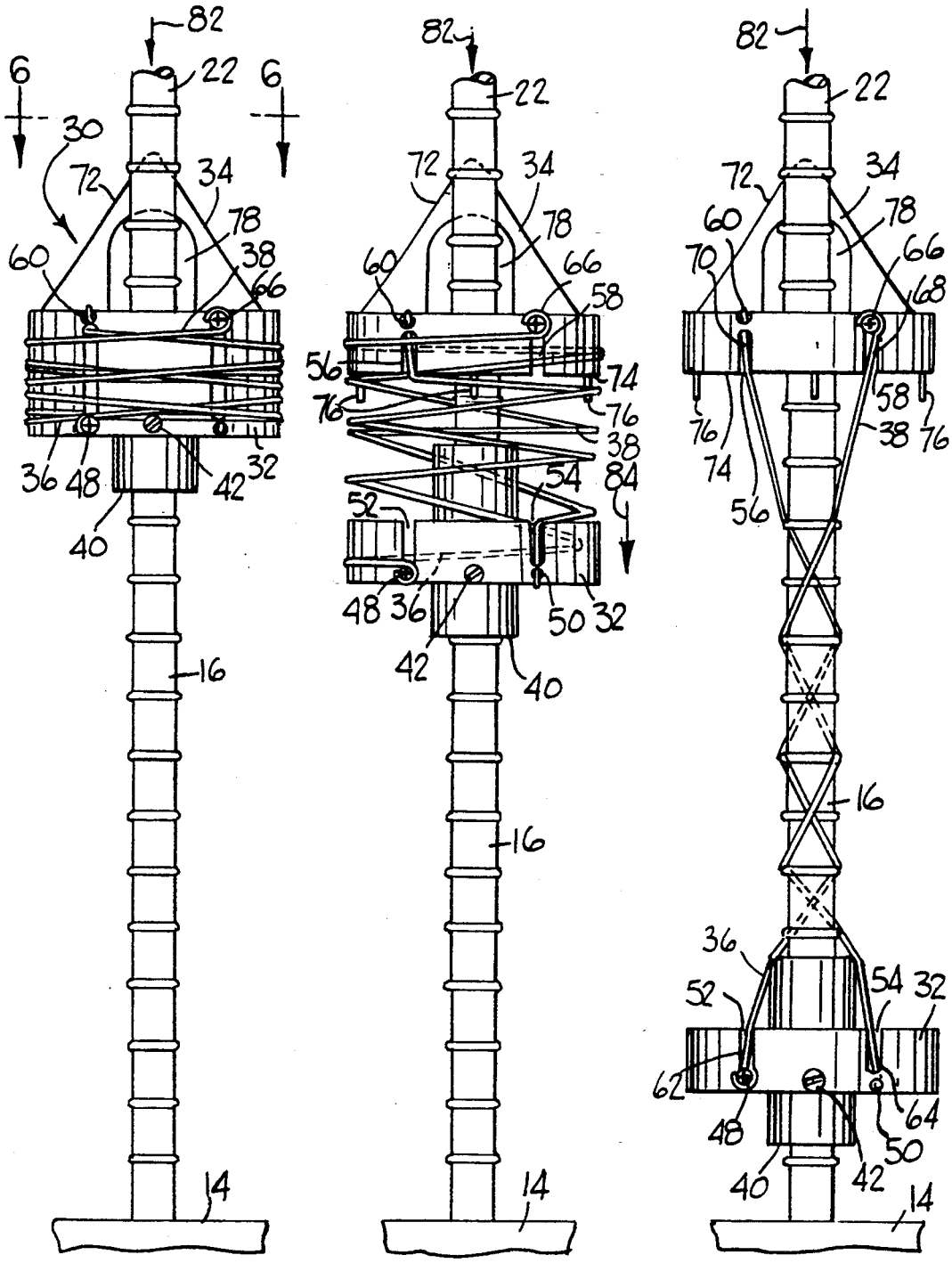
FIGS. 5A–5C are side elevation views showing a rod tying apparatus constructed in accordance with the invention during a sequence of operation for tying two rods together.

A lower circumferential edge 74 of the rod centering element 34 is adapted for mating engagement with the upper circumferential edge of the rod attachment element 32. In addition, as shown in FIGS. 5B and 5C, alignment pins 76 are attached to the rod centering element 34 for aligning the rod centering element 34 in a closed position with the rod attachment element 32.

The conical projection 72 of the rod centering element 34 is generally solid but includes a cutout 78. As shown in FIGS. 5A–5C, the cutout 78 allows the added length of reinforcing rod 22 to be placed into the rod holder 40 of the rod attachment element 32. In use, the added length of reinforcing rod 22 extends upward through the conical projection 72 substantially as shown.

The conical projection 72 is formed with a number of smaller openings 80. The openings 80 permit concrete grout to pack around the rod tying apparatus 10 when the cells 20 (FIG. 1) of the wall 10 are filled. Following erection of a concrete masonry unit wall 10, concrete grout is typically poured within the cells 20 and then a tamper or vibrator is used to pack the concrete into the cells 20.

Figure 8A:
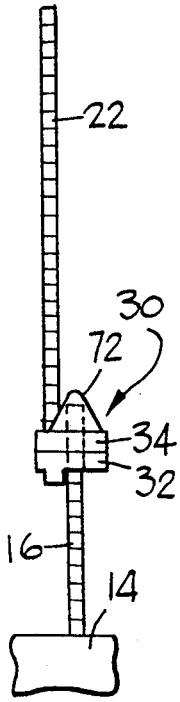
FIGS. 8A–8B are schematic views showing a rod tying apparatus constructed in accordance with the invention and showing a sequence of operations for tying two rods together.
Figure 8B:
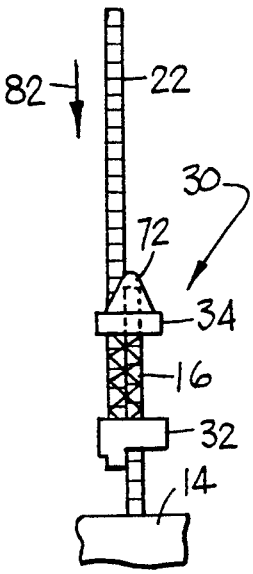

The inner surface of the conical projection 72 of the rod centering element 34 is adapted to rest on an upper edge of the anchored reinforcing rod 16 anchored in the foundation 14. This is shown in FIGS. 8A and 8B. The conical projection 72 is adapted to position the rod tying apparatus 30 on the reinforcing rod 16 and to juxtapose the added length of reinforcing rod 22 into substantial alignment with the anchored reinforcing rod 16. This permits the two rods 16, 22 to be tied together by the coils of wire 36, 38 as the rod centering element 34 and rod attachment element 32 are spread apart.

OPERATION

Figure 7:
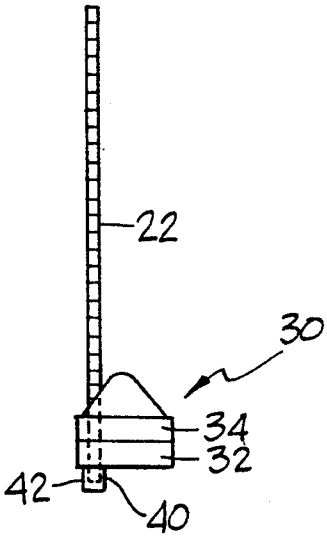
FIG. 7 is a schematic view showing a rod tying apparatus constructed in accordance with the invention and attached to a length of rod.

To begin a cycle of operation for the rod tying apparatus 30, the rod tying apparatus 30 is attached by an operator (e.g. mason) to an end of a length of added reinforcing rod 22. This is shown in FIG. 7. The added length of reinforcing rod 22 is placed through the cutout 78 in the rod centering element 34 and into the rod holder 40 of the rod attachment element 32. The threaded setscrew 42 of the rod attachment element 32 is then tightened for securely attaching the added length of reinforcing rod 22 to the rod holder 40. Tools which are readily available to a mason, such as a mortar trowel or screwdriver may be used to tighten the setscrew 42.

Next, and as shown in FIG. 8A, the rod tying apparatus 30 is placed over the anchored reinforcing rod 16 by the operator. (It to be understood that anchored reinforcing rod 16 need not be anchored in a foundation 14 but could be anchored on a stationary object such as another length of reinforcing rod). The conical projection 72 of the rod centering element 34 supports the rod tying apparatus 30 on the anchored reinforcing rod 16. In addition, the conical projection 72 centers the rod tying apparatus 30 so that the added length of reinforcing rod 22 is substantially aligned with the anchored reinforcing rod 16.

Next, and as shown in FIG. 8B, the operator pushes on the added length of reinforcing rod 22 as indicated by arrow 82. This causes the rod centering element 34 to separate from the rod attachment element 32. As the added length of reinforcing rod 22 is pushed downward by the operator the separation distance of the rod centering element 34 and rod attachment element 32 increases. This causes the coils of wire 36, 38 to tighten and wrap around the juxtaposed and aligned reinforcing rods 16 and 22. The uncoiled coils of wire 36, 38 tie the reinforcing rods 16 and 22 together at several points along the length of the anchored reinforcing rod 16. The exact number of tie points will depend on the lengths of the coils of wire 36, 38 and on the number or coils present. This sequence of operation is also clearly shown in FIGS. 5A–5C. In FIG. 5A, the rod tying apparatus 10, with the added length of reinforcing rod 22 attached thereto, has been placed on the anchored reinforcing rod 16. The rod centering element 34 is placed on the anchored reinforcing rod 16 and centers the rod tying apparatus 10 and aligns the added reinforcing rod 22 with the anchored reinforcing rod 16. In FIG. 5B, the operator pushing on the added reinforcing rod 22. Accordingly, the rod attachment element 32 begins to move downward as indicated by arrow 84. At the same time, the coils of wire 36, 38 begin to move together and tighten around the reinforcing rods 16, 22 aligned therebetween. In FIG. 5C, the elements 32 and 34 are completely separated and the coils of wire 36, 38 are tightly wrapped around the reinforcing rods 16, 22. This ties the reinforcing rods 16, 22 together at several points along the length of the anchored reinforcing rod 16.

The weight of the added length of reinforcing rod 22 will be sufficient to maintain the coils of wire 36, 38 tightly attached to the reinforcing rods 16, 22 and the rods tied together. Furthermore, the operator may push on the reinforcing rod 22 to make an even tighter connection desired however, the rods 16, 22 can be untied by the operator by simply lifting the rod tying apparatus 30 off of the anchored reinforcing rod 16.

Thus a blind tie can be made quickly and safely without the need for an additional access hole. The cells 20 between the concrete masonry units 12 can than be filled with concrete grout. The rod tying apparatus 30 is adapted to be encased in the concrete grout and remain a part of the finished structure. The openings 20 in the conical projection 72 of the rod centering element 34 allow the concrete grout to be distributed through and around the rod tying apparatus 30.

Figure 9B:
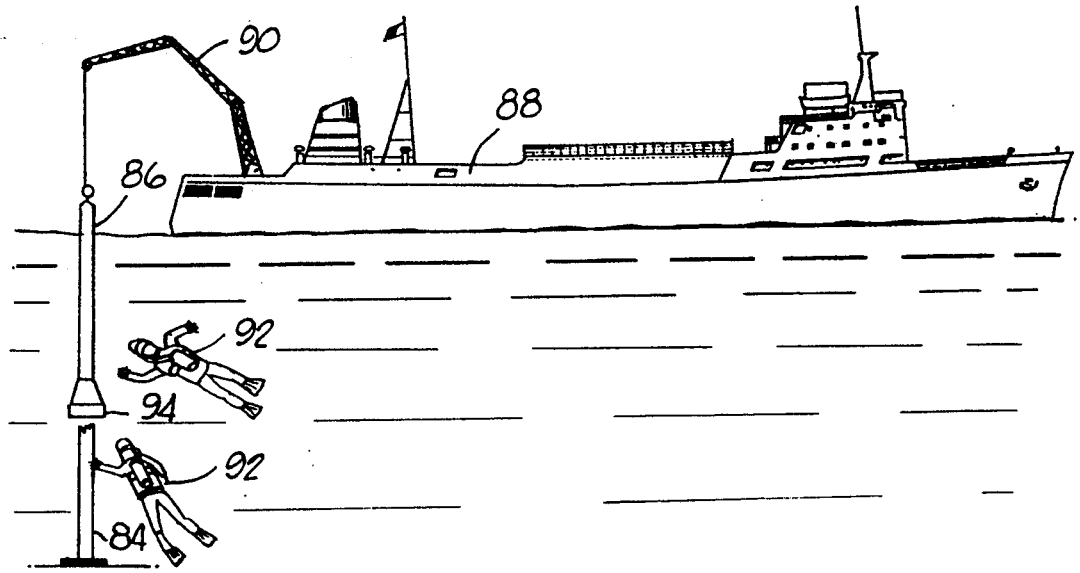
FIGS. 9A and 9B are schematic drawings showing another use for a rod typing apparatus constructed in accordance with the invention.
Figure 9A:
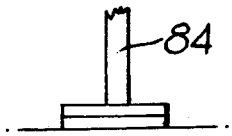

An alternate use for the rod tying apparatus is show in FIGS. 9A and 9B. A broken submerged pylon 84 is show in FIG. 9A. The broken submerged pylon 84 has a generally cylindrical shape. Such pylons are typically formed of wood anchored with concrete and have a tendency to break. By using a rod tying apparatus 94 constructed in accordance with the invention a new pylon 86 may be tied to the broken pylon 84. A ship 88 and crane 90 may be employed for hoisting the new pylon 86. In addition, divers 92 may be used for aligning the new pylon 86 with the broken pylon 84 and to assist in the tying operation using the rod tying apparatus 94 in a manner as previously described.

Although the invention has been described in connection with an illustrative embodiment, it is to be understood however, that the inventive concepts disclosed herein can be used in other contexts. As will be apparent then to those skilled in the art, certain changes and modifications can be made without departing from the scope of the invention as defined by the following claims.

What is claimed:

1. A tying apparatus for tying together first and second members comprising:

an attachment means for attachment to said first member;

a first and a second coil of wire each of said coils of wire attached to and wrapped around said attachment means in helical coils; and a centering means for positioning on said second member to align said first and second member for tying, said centering means attached to said coils of wire and separable from said attachment means to tighten said coils of wire around said first and second members.

2. The tying apparatus as claimed in claim 1 and wherein said centering means includes a conical projection as a guide means for contacting an end of said second member.

3. The tying apparatus as claimed in claim 2 and wherein said conical projection includes an opening for said first member.

4. The tying apparatus as claimed in claim 1 and wherein said second member is anchored.

5. The tying apparatus as claimed in claim 1 and wherein said first and second members are lengths of rebar.

6. The tying apparatus as claimed in claim 1 and wherein said first and second members are pylons.

7. A rod tying apparatus for blind tying a first rod to a second rod, said apparatus comprising:

a rod attachment element having a rod holder for attaching said first rod;

a rod centering element aligned with and separable from said rod attachment element and including a conical projection for contacting an end of said second rod to juxtapose said first and second rods; and first and second lengths of wire attached to and coiled around said rod attachment element and said rod centering element and adapted to wrap around and tie said first and second rods together upon separation of said rod attachment element and said rod centering element.

8. The rod tying apparatus as claimed in claim 7 and wherein said rod attachment element is a generally ring-like member and includes a tubular rod holder and a setscrew for attaching said first rod to said tubular rod holder.

9. The rod tying apparatus as claimed in claim 8 and wherein said rod centering element includes an opening through the conical projection for passing said first rod through said rod centering element.

10. The rod tying apparatus as claimed in claim 7 and wherein said second rod is anchored.

11. The rod tying apparatus as claimed in claim 7 and wherein said first and second rods are contained in a cell of concrete masonry unit wall.

12. The rod tying apparatus as claimed in claim 7 and wherein said rod tying apparatus is adapted to blind tie said first and second rods and to be encased in concrete within a concrete masonry unit wall.

13. The rod tying apparatus as claimed in claim 12 and wherein said conical projection of said rod centering element includes openings for distributing concrete around said rod tying apparatus.

14. The rod tying apparatus as claimed in claim 8 and wherein said first and second rods are formed of construction rebar.

15. A rod tying apparatus for tying a first rod to an anchored rod, said apparatus comprising:

a generally cylindrically shaped rod attachment element having a tubular rod holder attached thereto for holding said first rod;

a generally cylindrically shaped rod centering element for mating engagement with said rod attachment element and including a conical projection for contacting an end of said anchored rod for aligning said first rod and said anchored rod;

a first length of wire attached to and wound in a first helical coil around said rod attachment element and said rod centering element; and a second length of wire attached to and wound in a second helical coil around said rod attachment element and said rod centering element, with said first and second lengths of wire adapted to wrap around said first rod and said anchored rod as said rod attachment element and said rod centering element are separated by an operator pushing on said first rod.

16. The rod tying apparatus as claimed in claim 15 and wherein said first rod and said anchored rod are contained in a concrete masonry unit wall and are blind tied.

17. The rod tying apparatus as claimed in claim 16 and wherein said rod tying apparatus is adapted to be encased in concrete within said concrete masonry unit wall.

18. The rod tying apparatus as claimed in claim 17 and wherein said conical projection is formed with an opening for said first rod and multiple openings for concrete to be placed around said rod tying apparatus.

19. The rod tying apparatus as claimed in claim 18 and wherein said rod attachment element and said rod centering element includes cutouts for winding said first and second lengths of wire in opposite helical directions.

20. The rod tying apparatus as claimed in claim 19 and wherein said rod holder includes a threaded for securing said first rod to said rod holder.

21. In the construction of a structure formed of concrete masonry units having vertically extending cells, a method of blind tying reinforcing rods contained within the structure, said method comprising:

providing a rod tying apparatus having a rod attachment element and a rod centering element and lengths of wire coiled therearound;

attaching a first rod to said rod attachment element;

placing the rod centering element on an end of a second rod within a cell of a concrete masonry unit to align said first and second rods with one another; and separating the rod attachment element and rod centering element by pushing on said first rod such that said first and second lengths of wire wrap around and tie said first and second rods together.

22. The method as claimed in claim 21 and wherein said first and second rods are formed of rebar.

23. The method as claimed in claim 22 and wherein said second rod is anchored.

24. The method as claimed in claim 21 and further comprising encasing the rod tying apparatus in concrete within the wall.

* * * * *